United States Patent [19]

Kaftan

[11] 4,170,161

[45] Oct. 9, 1979

[54] TUNING DEVICE FOR A STRINGED INSTRUMENT

[76] Inventor: William P. Kaftan, 26620 Fairway Dr., Idyllwild, Calif. 92349

[21] Appl. No.: 821,682

[22] Filed: Aug. 4, 1977

[51] Int. Cl.[2] ..... G10D 3/14

[52] U.S. Cl. ..... 84/312 R; 84/297 R; 84/313

[58] Field of Search ..... 84/313, 297 R, 312 R

[56] References Cited

U.S. PATENT DOCUMENTS

| | | | |
|---|---|---|---|
| 3,237,502 | 3/1966 | Moseley | 84/313 |
| 3,248,991 | 5/1966 | Cole | 84/313 |
| 3,437,001 | 4/1969 | Kraft | 84/313 |

*Primary Examiner*—L. T. Hix
*Assistant Examiner*—S. D. Schreyer
*Attorney, Agent, or Firm*—Nilsson, Robbins, Dalgarn, Berliner, Carson & Wurst

[57] ABSTRACT

Strings attached at one end to the body of a musical instrument are each attached by adjustable means at the other end to a rockshaft so that the other end is secured to a point of attachment on a line through the axis of the rockshaft. The rockshaft has at least one cavity and the point of attachment may be varied through the axis of the rockshaft along the line so that a turning of the rockshaft simultaneously increases or decreases or leaves unchanged the tension in each of the strings and, thus, increases, decreases or leaves unchanged the pitch of each of the strings. The adjustable means may take the form of an adjusting screw that is in threaded engagement with the rockshaft and that is provided with means for securing the end of the string thereto; and the rockshaft may have a cavity for each string, including a slot portion for access of the string and a bore for the associated screw.

10 Claims, 11 Drawing Figures

FIG. 3
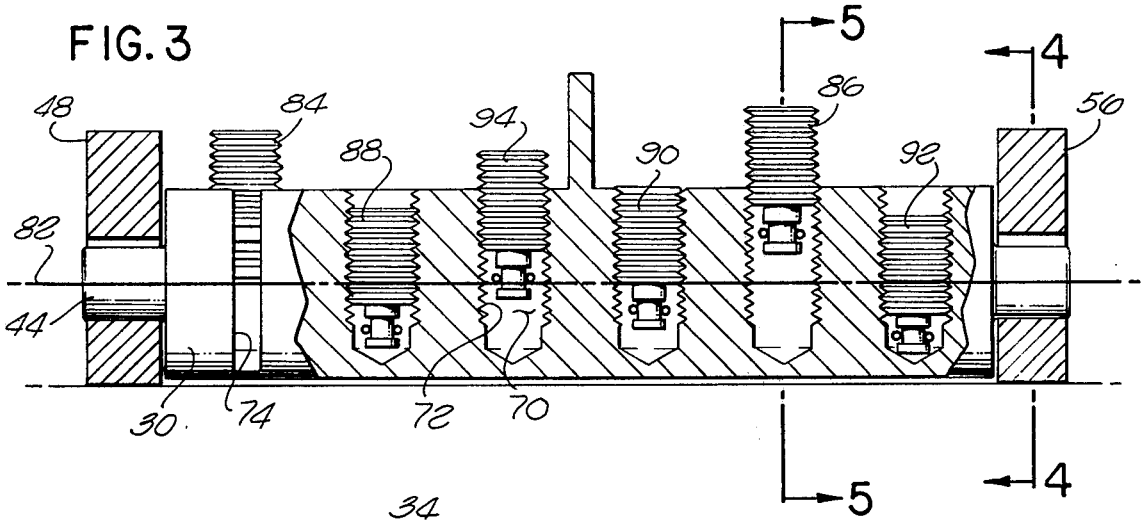
FIG. 4
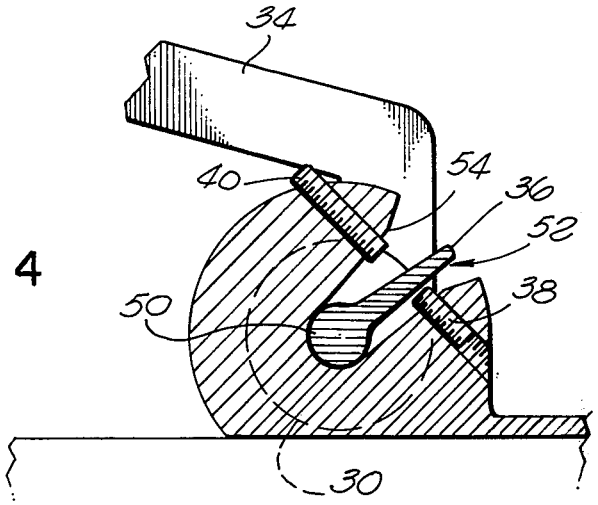
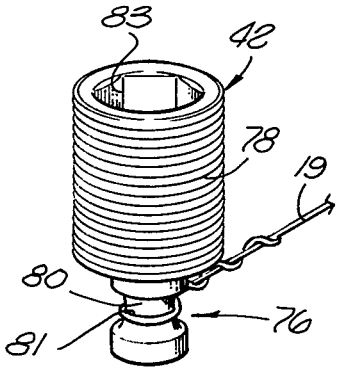
FIG.6
FIG.5
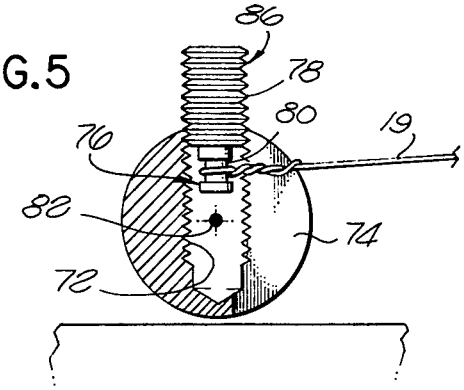
FIG.7
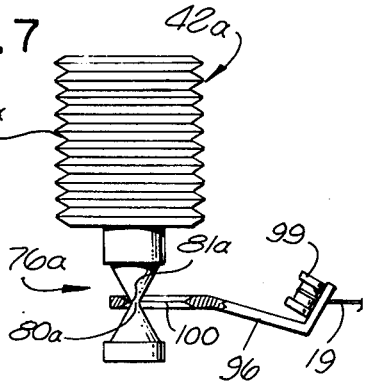
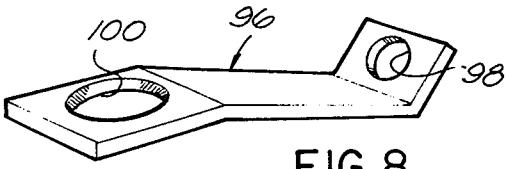
FIG.8

TUNING DEVICE FOR A STRINGED INSTRUMENT

BACKGROUND OF THE INVENTION

A. Field of Invention

The invention relates to stringed instruments, more particularly to devices for changing the tuning of the strings thereon simultaneously.

B. Description of Prior Art

In stringed instruments of the type under consideration, e.g., guitars, ukuleles, banjos, mandolins, and even violins, the pitch to which a string is tuned can be increased by stretching the string and thereby increasing its tension, and the pitch can be decreased by slackening the string and thereby decreasing its tension. The amount of the increase or decrease in tension controls the amount of the change in pitch for a given string under a given amount of initial tension.

Kraft U.S. Pat. No. 3,437,001 discloses a tuning device for a stringed instrument which employs a rockshaft to which the strings are attached, said rockshaft being manually rotatable. The strings are attached to the rockshaft so that they are effectively tangent to a circle centered on the axis of the rockshaft having a radius that can be adjusted for each string. The device is capable of increasing or decreasing the pitch of all the strings simultaneously, and it can be conveniently used to increase or decrease the pitch of all the strings by amounts which will preserve their initial tonal relationship, e.g., to tune all the strings up or down one-half step, etc.

Harlin U.S. Pat. No. 3,404,595 discloses a system of levers (two for each string) for increasing or decreasing the pitch of each string and a cross bar with adjustable screws for operating on all the strings in one motion. Though not specifically discussed, the device appears adapted to leaving the tuning of one or more strings unchanged while changing the tuning of the other strings. The tuning change generally begins at a different time for different strings, and the Harlin lever and cross bar system is designed for operation by a foot treadle.

The following patents, less relevant than Kraft and Harlin, are of some interest: Kauffman U.S. Pat. No. 2,241,911, Turman U.S. Pat. No. 2,949,806, Jeffery U.S. Pat. No. 3,252,368, Watson U.S. Pat. No. 3,382,749.

SUMMARY OF THE INVENTION

A chord tuning device adapted to be attached to a musical instrument having a body and a plurality of generally aligned tensioned strings attached to and extending along and over said body. The tuning device comprises a rockshaft disposed transverse to the strings with means for attaching one end of each of the strings to the rockshaft. The means for attaching is adjustable to position the end of the string to a predetermined point with respect to the axis of the rockshaft. There is also included means for rotating the rockshaft to simultaneously increase, decrease or leave unchanged the tension in each of the strings, depending upon the adjustment, and thereby increase, decrease or leave unchanged the pitch of each of the strings. The means for adjustably varying said position for each of said strings may comprise a tuning screw in threaded engagement with the rockshaft, said screw being provided with means for securing the said end of said string to said screw; and the rockshaft may have a cavity for each string, including a slot portion for access of the string and a bore portion for the associated screw.

BRIEF DESCRIPTION OF THE DRAWINGS

FIG. 3 is a sectional view taken on line 3—3 of FIG. 2.

FIG. 4 is a sectional view taken on line 4—4 of FIG. 3.

FIG. 5 is a sectional view taken on line 5—5 of FIG. 3.

FIG. 6 is a perspective view of the embodiment of an adjusting screw which is employed in the chord tuning device of FIG. 2.

FIG. 7 is an elevational view, partially in section and partially broken away, of an alternative embodiment of an adjusting screw showing a link means for attaching a string thereto.

FIG. 8 is a perspective view of the link means of FIG. 7.

DETAILED DESCRIPTION

On a stringed instrument of the type under consideration, the present invention has the capability to simultaneously increase the pitch of one or more strings, decrease the pitch of one or more other strings and leave unchanged the pitch of one or more additional strings. On a guitar equipped with an embodiment permitting changes in pitch over an adequate range, one could, for example, change from standard tuning (strings tuned from low to high end at E A D G B E) to a chosen type of open tuning (e.g., strings tuned to chord of F) using the device. Also, one could change a chord being fingered by the left hand to a desired, preset alternate chord while maintaining the same fingering. Other capabilities include the more limited capability to simultaneously increase or decrease the pitch of all the strings such that at the end of the pitch change the initial tonal relationship of the strings is preserved, e.g., the capability to tune all the strings up or down one-half step, one step, etc.

Figure 1:
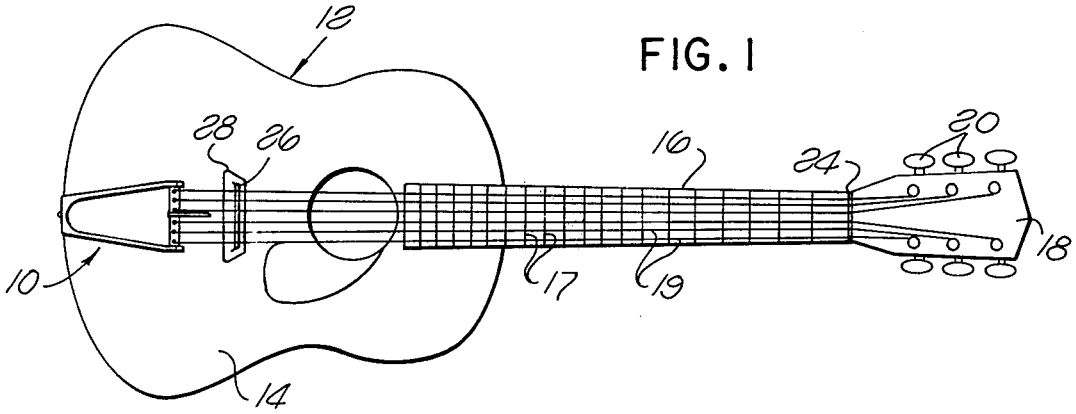
FIG. 1 is a plan view of a guitar with an embodiment of a chord tuning device made in accordance with the invention mounted in position on the guitar.

In FIG. 1, an embodiment 10 of a chord tuning device made in accordance with the invention is shown in position on guitar 12. The guitar has a body which includes a sounding box 14, an elongated neck 16 provided with frets 17 and a head 18. Six tensioned strings 19 are attached at the head end to tuning pegs 20. From the tuning pegs, the strings run in a generally aligned fashion along and over the body of the guitar to a chord tuning device 10, which is disposed transverse to said strings. A first bridge 24 for the strings is provided near the head end of the guitar and a second bridge 26 on a mounting 28 is provided near the tuning device 10.

Figure 2:
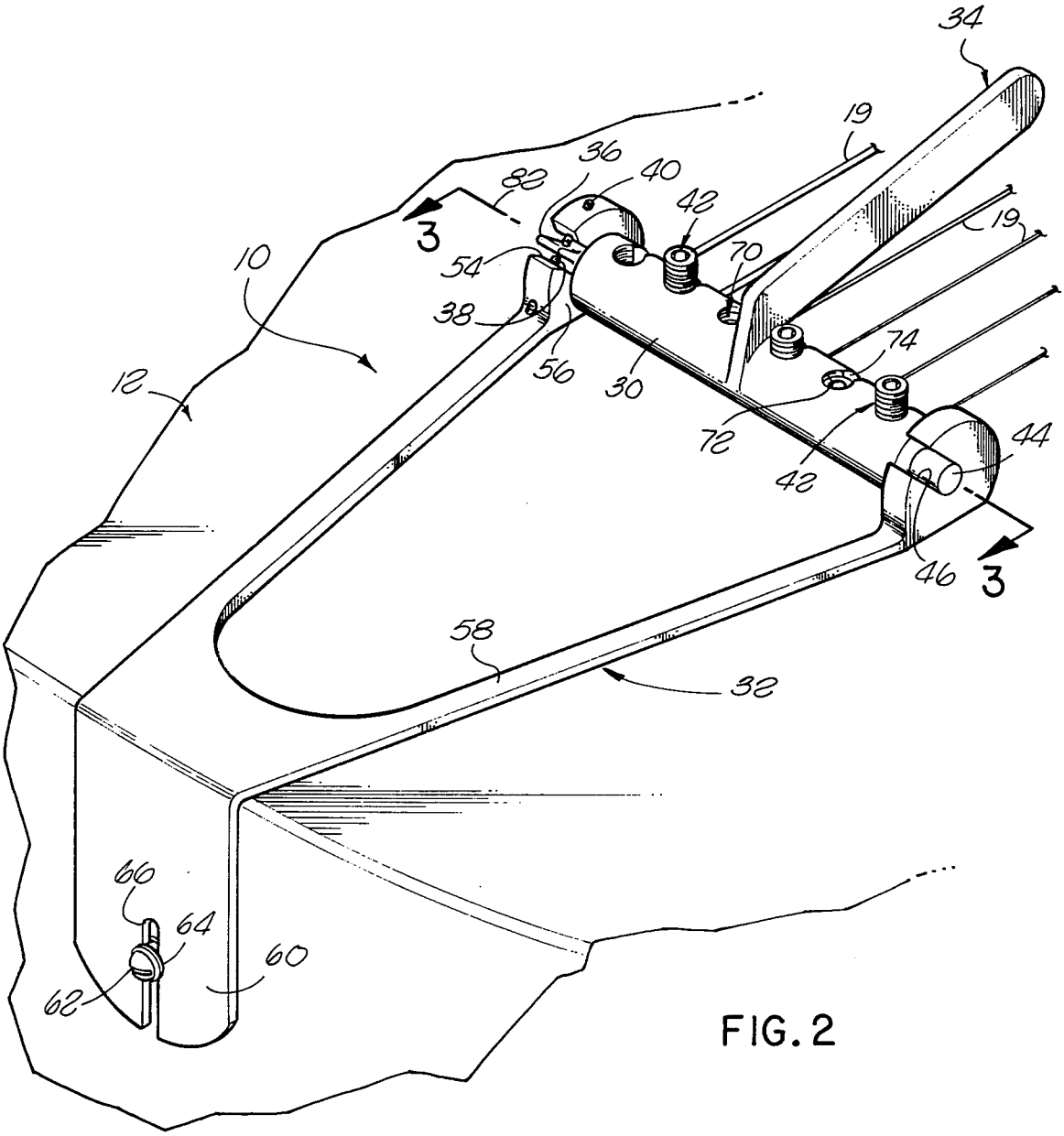
FIG. 2 is a fragmentary perspective view of a guitar with the embodiment of the chord tuning device mounted in position on the guitar.

Referring to the enlarged view of the tuning device 10 in FIG. 2, key elements of the device include: a rockshaft 30; mounting 32 for the rockshaft; lever 34 for turning or rotating the rockshaft; stop lever 36 and set screws 38 and 40 for limiting the extent of turning of the rockshaft; and adjusting screws 42.

From the figure, it is evident that lever 34 can be used to manually rotate rockshaft 30 in either direction to positions defined by set screws 38 and 40. One end 44 of the rockshaft turns in a cavity 46 defined by bushing 48, which is part of mounting 32. A curved portion 50 of endpiece 52, best shown in FIG. 4, turns with the rockshaft in cavity 54 which is defined by bushing 56, also a part of mounting 32. The endpiece also includes stop lever 36. Aluminum and steel are among the variety of materials from which rockshaft 30, lever 34 and endpiece 52 may be made, and welding is one of a variety of means which may be employed to attach the lever and endpiece to the rockshaft. Means other than a lever may be used for turning rockshaft 30. For example, a post attached to said rockshaft with a wire attached to said post could readily be employed.

Mounting 32 may conveniently be a unitary piece of aluminum, but could also be made of a variety of other materials. Said mounting includes the two aforementioned bushings 48 and 56 (FIG. 2), defining cavities 54 and 46; horseshoe-shaped portion 58, which lies flat against the body of the guitar; and connecting plate 60 which is approximately perpendicular to portion 58. The mounting is secured to the guitar by means of screw 62 which passes through sleeve 64 and through slot 66 in connecting plate 60, and which screws into the body of the guitar. Additional screws could be employed to screw horseshoe-shaped portion 58 of the mounting to the body of the guitar. Mounting 32, as well as rockshaft 30, can be conveniently constructed by using, as the only major pieces of equipment, a milling machine, a lathe, a drill press and a band saw.

In chord tuning device 10, shown in FIG. 2, the looped ends of strings 19 are attached to adjusting or tuning screws 42 (preferably made of steel) in the manner shown in FIG. 6. Each adjusting screw is, at least in part, in a cavity 70 having a bore portion 72 for the screw and a slot portion 74 for the access of the associated string. This, as well as the threaded engagement of the screws 42 with rockshaft 30, can best be seen by reference to FIGS. 2, 3 and 5.

By reference to FIGS. 5 and 6, it can be seen that the adjusting screws 42 have a securing means 76 at one end, below threaded portion 78. Said securing means (which is, of course, symmetrical about the axis of the screw) includes a central portion 80 for connecting a string 19 to the screw 42 and, thus, to rockshaft 30. For the purpose of describing the invention and designing chord tuning device 10, it is convenient to define a position or point of attachment to which a string 19 is secured. Assuming the string 19 in FIGS. 5 and 6 need not deviate, in order to form the connecting loop, from a line it follows in approaching securing means 76, the point of attachment may be then considered to be the point of intersection between the screw and the point along the left (front left in FIG. 6) portion of the loop at which the tension in the loop would be colinear with said line. Said point of attachment is shown at 81 in FIG. 6. Other assumptions could be made. For example, portion 80 might be considered infinitely thin at its thinnest part, in which case the point of attachment would intersect the axis of screw 42 and of bore portion 72 of cavity 70. Following this latter assumption, by reference to FIGS. 2, 3 and 5, it is evident that said position or point of attachment will define a line through the axis 82 of rockshaft 30. Then, with the axis of screw 42 and of bore portion 72 perpendicular to the axis of rockshaft 30, the point of attachment can be moved through the axis of the rockshaft—i.e., from above the axis, to and through the axis, to below the axis by turning screw 42. An hexagonal socket 83 is provided in screw 42 for the engagement of an Allen wrench which can then be used to turn screw 42, and thereby move it up and down in bore portion 72.

In FIG. 5, the point of attachment or position to which the string is secured (being substantially on a line perpendicular to the axis of the rockshaft) is above the axis of rockshaft 30. Thus, a turning of the rockshaft in a clockwise direction (as viewed in FIG. 5) will decrease the tension on string 19 and lower the pitch of the string. On the other hand, a turning in a counterclockwise direction will increase the tension on the string and increase the pitch of the string. If the point of attachment were moved below the axis, the effects (tension and pitch) would be the opposite. If the point of attachment were moved directly onto the axis, there would be no change in tension or change in pitch for a rotation in either direction.

FIG. 3 provides a view of the positions of all six adjusting screws. Looking along the axis 82 of rockshaft 30 from the end of the rockshaft near screw 84, one can readily see that a clockwise rotation will slacken the strings attached to screws 84 and 86, with the effect being somewhat greater for screw 86. The corresponding decrease in pitch for each of the two strings will depend on the characteristics of the string and the initial tension. Since the points of attachment for the strings attached to screws 88, 90 and 92 (said points of attachment, as with the points of attachment for the strings attached to screws 84, 86 and 94, being substantially on lines perpendicular to the axis of the rockshaft) are below the axis, the clockwise rotation will stretch these strings and increase their pitches. The point of attachment for the string attached to screw 94 is directly on the axis. Thus, there will be no change in the tension or pitch of that string for a rotation in either direction.

A point of attachment could be positioned on a line through the axis of the rockshaft which is not substantially perpendicular to said axis and be moved along said line without sacrificing the capability to simultaneously increase, decrease or leave unchanged the pitch of each of the strings. Thus, a design with the bore and adjusting screw axis intersecting (or substantially intersecting) the rockshaft other than perpendicularly might be employed.

Among the variety of possible designs for a screw and a method of securing the end of a string 19 to a position (point of attachment), are a screw and method disclosed in Kraft U.S. Pat. No. 3,437,001, illustrated in FIGS. 7 and 8. As shown in these figures, link 96 has a hole 98 for a ferrule 99 to which string 19 is attached and a larger hole 100 having a knife edge. Hole 100 is large enough to fit over the bottom portion of securing means **76*a*, and the position to which string 19 is secured (point of attachment) is the contact point 81*a* of the knife edge with central portion 80*a* of the securing means. The thinner that portion 80*a*** becomes, the better is an approximation that the point of attachment is along the axis of the screw and the axis of a bore in which the screw may (perhaps in part) be disposed.

Figure 9:
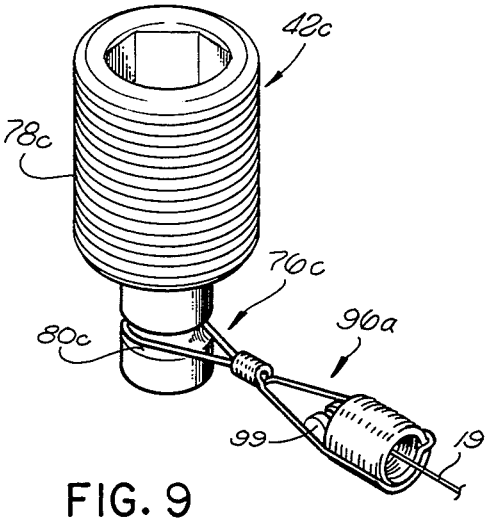
FIG. 9 is a perspective view of another alternative embodiment of an adjusting screw showing an alternative embodiment of a link means for attaching a string thereto.

Another design for a screw and securing method is shown in FIG. 9. In this case, link 96*a* is formed from a wire. The wire loops around central portion 80*c* of tuning screw 42*c* and, proceeding along the link toward the neck of the guitar, is formed into a twisted portion, which is soldered, and then into a second loop. From the end of the last mentioned loop nearest the neck of the guitar, one end of the wire is formed into an inside coil running back toward tuning screw 42*c*, and the other end is formed into an outside coil, running in the same direction, which is wrapped around the inside coil. As with the twisted portion, the coils are soldered. Although the wire may be made of a variety of materials, the properties of nickel are particularly favorable. Numerous variations, for example with the inside and outside coils still being formed from the end of said last mentioned loop nearest the neck of the guitar, but running toward the neck of the guitar, are readily apparent. A design in which central portion 80*c* of tuning screw 42*c* has a semicircular shaped cross section, as shown, with (the full circle having) a diameter equal to approximately twice the diameter of the wire from which link 96*a* is formed, results in a generally desirable mode of operation of the tuning screw 42*c* and link 96*a*.

A link similar to link 96 in FIGS. 7 and 8, could, of course, be used with tuning screws 42 or 42*c*. The knife edge of hole 100 would not be needed. However, a design with the link defining, at a hole similar to hole 100, a cross-section in the shape of a semi-circle with a diameter equal to approximately half of the semi-circular cross-sectional diameter of central portion 80*c*, should result, along the lines indicated above, in a generally desirable type of operation.

Along these same lines, the elimination of link 96*a* in FIG. 9 with direct attachment, as in FIG. 6, and with approximately a two-to-one ratio of the semi-circular cross-sectional diameter of central portion 80*c* to the circular cross-sectional diameter of the string 19 at its looped portion, is another useful design.

When the point of attachment for a string 19 used with chord tuning device 10 is set, the change in tension (for a point of attachment not on the axis of the rockshaft) and, thus, the change in pitch will be determined by the direction and amount of rotation of rockshaft 30. FIG. 4 shows in some detail the means employed to limit the extent of rotation of rockshaft 30 in both directions. Referring to FIG. 4, the rotation of rockshaft 30 will be limited in one direction by the contact between stop lever 36 and set screw 38 and in the other direction by the contact between said lever and set screw 40. Set screw 38 is normally disposed so that it extends only a slight amount into cavity 54, and the position of said screw is normally not changed. Thus, most of the adjustment is accomplished by turning set screw 40 and thereby adjusting the amount it extends into cavity 54. For a rotation of rockshaft 30 through an angle of about 20 degrees, a range of as much as approximately one octave in pitch up or down from a standard tuning may be set for a string, depending upon the string's characteristics and initial tension.

In FIG. 2, assume, as is shown, that stop lever 36 is against set screw 38 and that the device is at rest. Then, one of three situations must obtain: (1) the adjusting screws 42 may be positioned so that the net torque of strings 19 on rockshaft 30 tends to push lever 36 into screw 38; (2) the adjusting screws may be positioned so that there is no net torque; or (3) the screws may be positioned so that the net torque tends to push the lever toward screw 40 but is not of sufficient magnitude to overcome the friction resisting its effect. If the first alternative obtains and the torque is strong enough to overcome any friction in the system, then a rotation of rockshaft 30 until stop lever 36 encounters set screw 40, will, upon the release of lever 34, be followed by the automatic return of the rockshaft to its initial position. If this action takes place while a chord is being held by the left hand, then a slurrying effect will occur due to the first rotation and substantially the reverse effect will automatically occur when the lever 34 is released. With this in mind, one may decide what sort of effect one desires and then initially tune the guitar with a torque which will achieve the desired effect. (A variety of torques can, of course, be created for a given tuning.) A spring or spring system (not shown) could also be used to, for example, control these effects. For example, a spring could be attached to lever 34 tending to rotate stop lever 36 toward screw 38 with enough force to overcome any reasonable torque that may be exerted by strings 19 in the other direction. Then the rockshaft 30 will always automatically return to the position defined by screw 38.

Tuning of each string is normally accomplished by first tuning it to its desired pitch with the rockshaft 30 in one position (e.g., with lever 36 against set screw 38). Then, after the rockshaft is turned to its other position (e.g. with lever 36 against set screw 40), the string is tuned to a desired higher or lower pitch or back to its initial pitch by adjusting its associated screw 42. Since each tuning operation affects the tuning in the alternate position, repetition of the first operation is usually required following the second tuning operation. Finer tuning of the string may be achieved by continuing the process.

Figure 10:
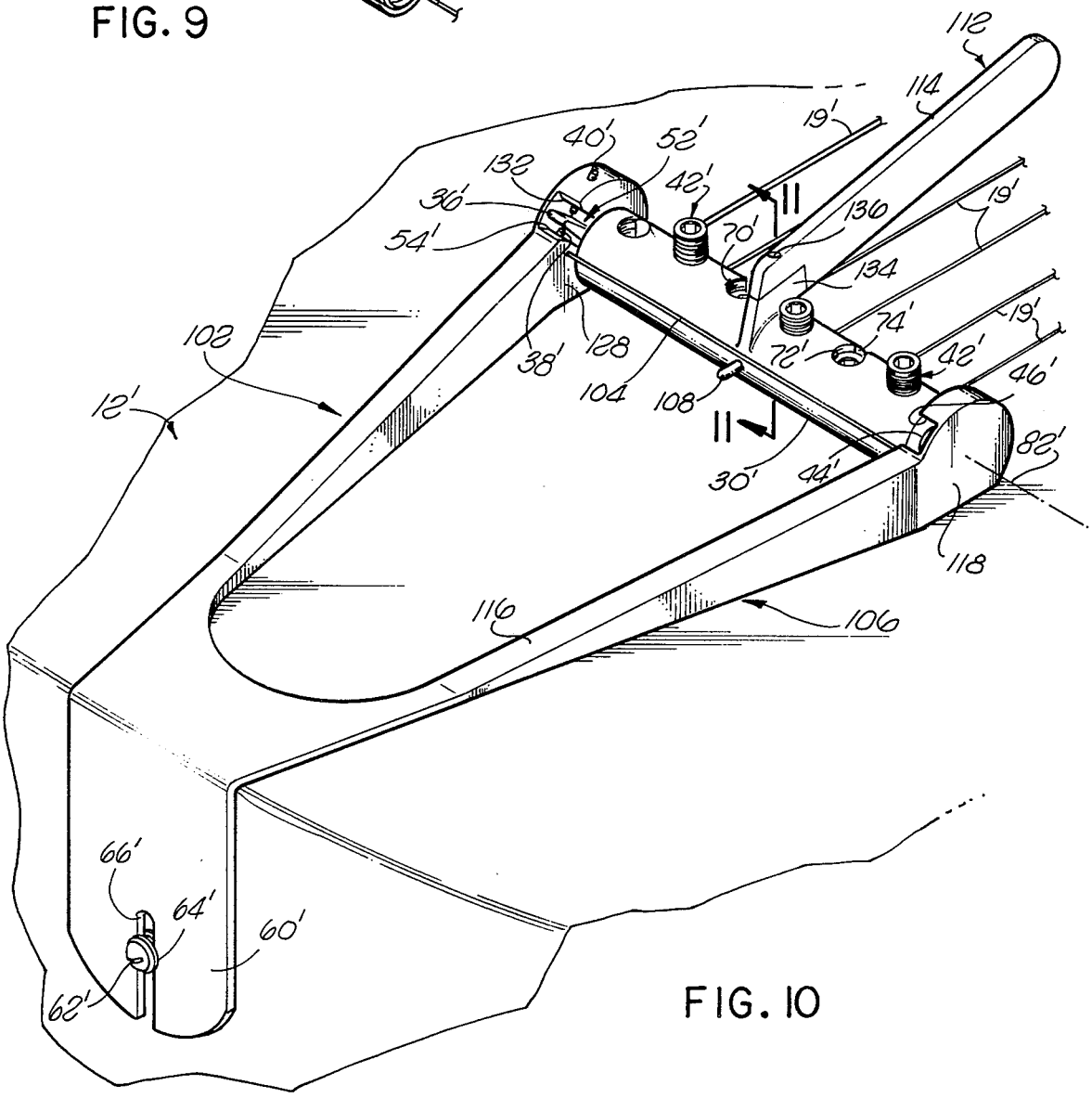
FIG. 10 is a fragmentary perspective view of a guitar with an alternative embodiment of a chord tuning device made in accordance with the invention mounted in position on the guitar.

An alternative embodiment 102 of a chord tuning device made in accordance with the invention is shown in FIG. 10. The parts of the device and guitar designated with primed numbers are identical in design and function to the respective parts in prior drawings which are designated by identical numbers, apart from the prime symbols.

Two major differences exist between this embodiment and the embodiment of FIG. 2. The first relates to inclusion in this embodiment of a band 104, connected to the mounting 106, and of a nipple 108, attached to and extending from the rockshaft 30', which together provide a mechanism for locking the rockshaft. The second relates to the inclusion in this embodiment of a lever 112 having a part 114 which may be rotated to a position in which part 114 is generally aligned with the axis 82' of the rockshaft. This position may facilitate storage of the device and strumming (or other playing techniques) near the rockshaft.

Before addressing the aforementioned major differences, a number of minor differences should be briefly noted. The employment of a thickened horseshoe-shaped portion 116 of the mounting 106 and the use of bushings 118 and 120 which provide solid boundaries to the outer ends of cavities 46' and 54' are essentially unrelated to the operation of the tuning device. They do, nevertheless, require other changes, also unrelated to operation, including a widening along the longitudinal axis 82' (of the rockshaft 30') of bushings 118 and 120 and a widening of the portions of horseshoe-shaped portion 116 extending from the bushings, as compared with the embodiment of FIG. 2. Also, the thickened horseshoe-shaped portion 116 requires a hole (not shown) for set screw 38' which runs from cavity 54' through bushing 120 to the underside of the horseshoe-shaped portion. Thus in this embodiment, set screw 38' must be positioned before the tuning device is placed on the quitar.

Figure 11:
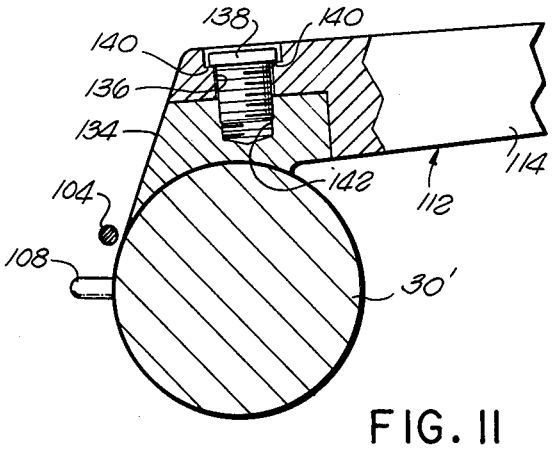
FIG. 11 is a sectional view taken on line 11—11 of FIG. 9.

Returning to the major changes mentioned above, these changes can be best understood by reference to FIG. 10 along with FIG. 11. Band 104 extends along rockshaft 30' in close proximity to said rockshaft without being in contact with it. The design is such that nipple 108 will approach band 104 as stop lever 36' turns toward set screw 40', or, with the screw positioned so that it doesn't extend into cavity 54', toward the boundary 132 of said cavity along the side of bushing 120 from which the set screw enters the cavity. However, when stop lever 36' is against said boundary along said side, nipple 108 is close to but not in contact with band 104. But the band is elastic (It may, for example, be an elastic band made of metal, and also include or be used with a mechanism for changing its tension.). Thus it can be stretched, lifted over the nipple and, by engagement with said nipple from the side opposite the side on which the band is disposed in FIGS. 10 and 11, exert a force which will lock the rockshaft against said boundary 132 of cavity 54'. When set screw 40' is positioned so that it extends into cavity 54', band 104 can similarly be used to lock the rockshaft to a position in which stop lever 36' is against said set screw. Thus band 104 and nipple 108 can be used to lock the rockshaft to a position corresponding to a desired tuning, independently of the stable position of the rockshaft (determined by the torque exerted by the strings and friction) without employment of the locking mechanism.

As best shown in FIG. 11, lever 112 includes two parts: a part 114, which includes the elongated arm of the lever and a base 134 which is directly attached to rockshaft 30'. Part 114 has a hole 136 therethrough, which is not threaded, for a screw 138, and shoulders 140 for engagement with the head of said screw. Base 134 of the lever has a threaded cavity 142 for engagement with the threads of said screw. Part 114 can rotate about the axis of said screw and, thus, be positioned so that it is generally aligned with the axis 82' of the rockshaft. The aligned position may facilitate storage of the tuning device and strumming (or other playing techniques) near the rockshaft. A spring or spring system (not shown) could be used with lever 112 to provide an automatic return (e.g., while playing when clearance near the rockshaft is no longer required) of part 114 to the position of FIGS. 10 and 11.

It should be evident that the designs for a screw and securing method shown in FIGS. 7, 8 and 9, as well as others, may be employed as readily in the embodiment of FIG. 10 as in the embodiment of FIG. 2.

It will, of course, be appreciated that the embodiments of this invention which have been described have been given by way of illustration and may be modified without departing from the spirit of this invention.

What is claimed is:

1. A tuning device for a stringed musical instrument having a body and a plurality of generally aligned tensioned strings attached at one end to said body and extending along and over said body, said device comprising:

(A) a rockshaft mounted on said body, said rockshaft having a longitudinal axis, having at least one cavity and being disposed transverse to said strings;

(B) means for attaching the other end of each of said strings to said rockshaft so that said end is secured to a position on a line through said axis of said rockshaft, and for adjusting said position to a predetermined point on said line;

(C) means for turning said rockshaft so as to increase, decrease or leave unchanged the tension in each of said strings simultaneously and thereby increase, decrease or leave unchanged the pitch of each of said strings simultaneously; and (D) means for limiting the extent of turning of said rockshaft, said means including, (1) a stop lever attached to said rockshaft at one end thereof, (2) a mounting for said rockshaft having a cavity for said lever, (3) a first screw for limiting the extent of said turning in one direction in threaded engagement with said mounting and protruding into said cavity for said lever, and (4) a second screw for limiting the extent of said turning in the other direction in threaded engagement with said mounting and protruding into said cavity for said lever.

2. A tuning device for a stringed musical instrument having a body and a plurality of generally aligned tensioned strings attached at one end to said body and extending along and over said body, said device comprising:

(A) a rockshaft mounted on said body, said rockshaft having a longitudinal axis, having at least one cavity and being disposed transverse to said strings;

(B) means for attaching the other end of each of said strings to said rockshaft so that said end is secured to a position on a line through said axis of said rockshaft, and for adjusting said position to a predetermined point on said line;

(C) means for tuning said rockshaft so as to increase, decrease or leave unchanged the tension in each of said strings simultaneously and thereby increase, decrease or leave unchanged the pitch of each of said strings simultaneously; and (D) means for locking said rockshaft, said means including, (1) a nipple attached to said rockshaft, and (2) a blocking element mounted on said body of said musical instrument independently of said rockshaft for blocking a turning of said rockshaft by engagement with said nipple.

3. A tuning device as defined in claim 2 wherein said blocking element comprises a portion of an elastic band extending along said rockshaft.

4. A tuning device as defined in claim 3 wherein said elastic band is in close proximity to but is not in contact with said rockshaft.

5. A tuning device for a stringed musical instrument having a body and a plurality of generally aligned tensioned strings attached at one end to said body and extending along and over said body, said device comprising:

(A) a rockshaft mounted on said body, said rockshaft having a longitudinal axis, having at least one cavity and being disposed transverse to said strings;

(B) means for attaching the other end of each of said strings to said rockshaft so that said end is secured to a position on a line through said axis of said rockshaft, and for adjusting said position to a predetermined point on said line;

(C) means for turning said rockshaft so as to increase, decrease or leave unchanged the tension in each of said strings simultaneously and thereby increase, decrease or leave unchanged the pitch of each of said strings simultaneously;

(D) means for limiting the extent of turning of said rockshaft, said means including:

(1) a stop lever attached to said rockshaft at one end thereof, and (2) a mounting for said rockshaft having a cavity for said lever; and (E) means for locking said rockshaft, said means including, (1) a nipple attached to said rockshaft, and (2) a blocking element mounted on said body of said musical instrument independently of said rockshaft for blocking a turning of said rockshaft by engagement with said nipple.

6. A tuning device as defined in claim 5 wherein said blocking element by engagement with said nipple blocks a turning of said rockshaft away from a position in which said stop lever is against a boundary of said cavity.

7. A tuning device as defined in claim 5 wherein said limiting means further comprises an adjustable screw in threaded engagement with said mounting and protruding into said cavity for said lever.

8. A tuning device as defined in claim 7 wherein said blocking element by engagement with said nipple blocks a turning of said rockshaft away from a position in which said stop lever is against said screw.

9. A tuning device for a stringed musical instrument having a body and a plurality of generally aligned tensioned strings attached at one end to said body and extending along and over said body, said device comprising:

(A) a rockshaft mounted on said body, said rockshaft having a longitudinal axis, having at least one cavity and being disposed transverse to said strings;

(B) means for attaching the other end of each of said strings to said rockshaft so that said end is secured to a position on a line through said axis of said rockshaft, and for adjusting said position to a predetermined point on said line;

(C) means for turning said rockshaft so as to increase, decrease or leave unchanged the tension in each of said strings simultaneously and thereby increase, decrease or leave unchanged the pitch of each of said strings simultaneously; and (D) means for limiting the extent of turning of said rockshaft, and means including means for adjusting said limiting of the extent of turning, and comprising, (1) a stop lever attached to said rockshaft, (2) a mounting for said rockshaft having a cavity for said lever, (3) a first screw for limiting the extent of said turning in one direction, in threaded engagement with said mounting and protruding into said cavity, the extent of said protruding into said cavity by said first screw being adjustable, and (4) a second screw for limiting the extent of said turning in the other direction, in threaded engagement with said mounting and protruding into said cavity, the extent of said protruding into said cavity by said second screw being adjustable.

10. A tuning device for a stringed musical instrument having a body and a plurality of generally aligned tensioned strings attached at one end to said body and extending along and over said body, said device comprising:

(A) a rockshaft mounted on said body, said rockshaft having a longitudinal axis, having a cavity for each string and being disposed transverse to said strings;

(B) means for attaching the other end of each of said strings to said rockshaft so that said end is secured to a position on a line through said axis of said rockshaft, and for adjusting said position to a plurality of alternative predetermined points on said line, including a point on said axis, said attaching and adjusting means including an adjusting screw for each string in threaded engagement with said rockshaft, said screw including means for securing said other end of said string to said screw; and (C) means for turning said rockshaft so as to increase, decrease or leave unchanged the tension in each of said strings simultaneously and thereby increase, decrease or leave unchanged the pitch of each of said strings simultaneously;

(D) said cavity for each string including a slot portion for access of said string and a bore portion for receiving said associated screw.

* * * * *